US007141923B2

(12) United States Patent
Song et al.

(10) Patent No.: US 7,141,923 B2
(45) Date of Patent: Nov. 28, 2006

(54) FIELD EMISSION DISPLAY IN WHICH A FIELD EMISSION DEVICE IS APPLIED TO A FLAT DISPLAY

(75) Inventors: Yoon Ho Song, Daejeon-Shi (KR); Chi Sun Hwang, Daejeon-Shi (KR); Kwang Bok Kim, Daejeon-Shi (KR)

(73) Assignee: Electronics and Telecommunications Research Institute, Daejeon-shi (KR)

( * ) Notice: Subject to any disclaimer, the term of this patent is extended or adjusted under 35 U.S.C. 154(b) by 0 days.

(21) Appl. No.: 10/824,547

(22) Filed: Apr. 15, 2004

(65) Prior Publication Data

US 2005/0127821 A1 Jun. 16, 2005

(30) Foreign Application Priority Data

Dec. 10, 2003 (KR) ..... 10-2003-0089372

(51) Int. Cl.
*H01J 1/62* (2006.01)

(52) U.S. Cl. ..... 313/497; 313/495; 313/502; 313/505

(58) Field of Classification Search ..... 313/495–497, 313/502–505; 315/169.3, 169.4
See application file for complete search history.

(56) References Cited

U.S. PATENT DOCUMENTS

| | | | | |
|---|---|---|---|---|
| 5,015,912 | A | 5/1991 | Spindt et al. | |
| 5,402,041 | A | 3/1995 | Kishino et al. | |
| 5,616,991 | A | 4/1997 | Casper et al. | |
| 6,507,329 | B1 * | 1/2003 | Cathey et al. | 345/75.2 |
| 6,580,223 | B1 * | 6/2003 | Konishi et al. | 315/169.3 |
| 2002/0047588 | A1 * | 4/2002 | Xia | 315/169.4 |
| 2003/0184213 | A1 * | 10/2003 | Hofmann et al. | 313/495 |
| 2004/0027050 | A1 * | 2/2004 | Rasmussen | 313/495 |
| 2004/0212315 | A1 * | 10/2004 | Rasmussen | 315/169.3 |

FOREIGN PATENT DOCUMENTS

| | | |
|---|---|---|
| JP | 07-130306 | 5/1995 |
| JP | 08115654 | 5/1996 |
| JP | 2001076652 | 3/2001 |
| JP | 2001084927 | 3/2001 |
| KR | 2002-0051214 | 6/2002 |

OTHER PUBLICATIONS

W. B. Choi, et al.; "A 4.5—in. Fully Sealed Carbon Nanotube-Based Field-Emission Flat-Panel Display"; L2.1: Late-News Paper; SID 99 Digest; pp. 1134-1137. (year 1999).

Z. Li Tolt, et al.; "Addressable Carbon Thin Film Cathode"; 38.3/Tolt; Asia Display 98; pp. 1153-1156. (year 1998).

R. Baptist, et al.; "Microtips and Resistive Sheet: A Theoretical Description of the Emissive Properties of this System"; 9th International Vacuum Microelectronics Conference, St. Petersburg 1996; pp. 19-23.

* cited by examiner

*Primary Examiner*—Tuyet Thi Vo
(74) *Attorney, Agent, or Firm*—Mayer, Brown, Rowe & Maw LLP

(57) ABSTRACT

Provided is a field emission display in which a gate hole having an inclined inner wall and a gate electrode around the gate hole are formed between an anode plate having a phosphor and a cathode plate having a field emitter and a control device for controlling a field emission current, whereby the voltage applied to the gate electrode of the gate plate serves to prohibit an electron emission of the field emitter by the anode voltage, and prevent a local arching by forming a totally uniform potential, so that the life time of the field emission display can be improved, and the gate hole having the inclined inner wall enables a fabrication of a filed emission display panel having a high brightness without an additional focusing grid.

30 Claims, 8 Drawing Sheets

FIELD EMISSION DISPLAY IN WHICH A FIELD EMISSION DEVICE IS APPLIED TO A FLAT DISPLAY

BACKGROUND

1. Field of the Invention

The present invention relates to a field emission display (FED) in which a field emission device is applied to a flat display, and more particularly, to a field emission display comprising a gate hole having an inclined inner wall between an anode plate having a phosphor and a cathode plate having a field emitter and a control device for controlling field emission current, and a gate electrode around the top of the gate holes, wherein the field emitter of the cathode plate is constructed to be opposite to the phosphor of the anode plate through the gate hole.

2. Discussion of Related Art

A field emission display is a device representing an image through cathodeluminescence of a phosphor, by colliding an electron emitted from a field emitter of a cathode plate against the phosphor of an anode plate, wherein the cathode plate having the field emitter and the anode plate having the phosphor are formed to be opposite to each other and be separated by a given distance (for example, 2 mm), by means of vacuum packaging. Recently, many researches and developments have been made on the field emission display as a flat display capable of replacing a conventional cathode ray tube (CRT). Electron emission efficiency in the field emitter being a kernel constitutional element of the field emission display cathode plate is variable depending on a device structure, an emitter material and a shape of the emitter.

The structure of the field emission device can be mainly classified into a diode type having the cathode (or emitter) and the anode, and a triode type having the cathode, the gate and the anode. Metal, silicon, diamond, diamond like carbon, carbon nanotube, and the like have been used commonly as the emitter material. Generally, the metal and silicon have been fabricated to the triode structure, and the diamond, carbon nanotube, and etc. manufactured to the diode structure.

The diode field emitter is usually formed by making diamond or carbon nanotube a film-shaped. The diode field emitter has advantages in simplicity of the manufacturing process and high reliability of the electron emission, even though it has disadvantages in controllability of the electron emission and low-voltage driving, as compared with the triode field emitter.

Hereinafter, a conventional field emission display having a field emitter will be described with reference to the accompanying drawings.

FIG. 1 is a perspective view for schematically illustrating a construction of a conventional field emission display having a diode field emitter.

A cathode plate has cathode electrodes 11 arranged in a belt shape on a lower glass substrate 10B, and film-shaped field emitter materials 12 on a portion thereof. An anode plate has transparent anode electrodes 13 arranged in a belt shape on an upper glass substrate 10T, and phosphors 14 of red (R), green (G) and blue (B) on a portion thereof. The elements of the cathode plate and the anode plate, as mentioned above, are vacuum packaged in parallel, while facing each other, by using spacers 15 as a supporter. The cathode electrodes 11 of the cathode plate and the transparent anode electrodes 13 of the anode plate are arranged to intersect each other. In the above, an intersecting region is defined as a one pixel.

In the field emission display shown in FIG. 1, an electric field required for an electron emission corresponds to a voltage difference between the cathode electrodes 11 and the anode electrodes 13, divided by the cathode-anode distance. It has been commonly noted that the electron emission occurs in the field emitter when the electric field is applied to the field emitter material in the value of 0.1 V/μm or more.

FIG. 2 shows the field emission display proposed for improving the disadvantages of the field emission display shown in FIG. 1, which schematically illustrates a construction of a conventional field emission display using a control device for controlling the field emitter in each pixel of the cathode plate.

The cathode plate includes belt-shaped scan signal lines 21S and data signal lines 21D, which are formed of a metal on a glass substrate 20B and capable of an electrical row/column addressing, a film (thin or thick film) shaped field emitter 22, in which each pixel defined by the scan signal line 21S and the data signal line 21D is formed of diamond, diamond like carbon, carbon nanotube, etc., and control devices 23 connected to the scan signal line 21S, the data signal line 21D and the field emitter 22 to control a field emission current depending on scan and data signals of the display. The anode plate includes transparent anode electrodes 24 arranged in a belt shape on a glass substrate 20T, and phosphors 25 of red (R), green (G) and blue (B) on a portion thereof. The cathode plate and the anode plate are vacuum packaged in parallel, while facing each other, by using spacers 26 as a supporter.

In the field emission display shown in FIG. 2, a high voltage is applied to the anode electrodes 24 to induce an electron emission from the film-shaped field emitter 22 in the cathode plate, and to accelerate the emitted electrons with high energy at the same time. Then, if a signal of the display is inputted to the control devices 23 through the scan signal line 21S and the data signal line 21D, the control device 23 controls the amount of electrons emitted from the film-shaped field emitter to represent row/column images.

The diode field emitter used for the field emission displays shown in FIGS. 1 and 2, as described above, has advantages that the structure is simple and the manufacturing process is easy, since it does not need a gate and a gate insulating film unlike a conic triode field emitter.

Further, the diode field emitter has very low probability in the breakdown of the field emitter by the sputtering effect of positively ionized particles generated by a collision of electrons to remnant gases, so that it has a high reliability and there is no breakdown phenomenon of the gate and the gate insulator, which is very problematic in the triode field emitter.

In the field emission display having the diode field emitter shown in FIG. 1, however, a high electric field (generally, several V/μm) necessary for field emission is applied through the electrodes (cathode electrodes 11 and transparent anode electrodes 13 in FIG. 1) of the upper and lower plates being separated by a significant distance (usually, 200 μm to 2 mm), so that a display signal having a high voltage is required. As a result, there is a disadvantage that an expensive high voltage driving circuit is required.

Particularly, in the field emission display having the diode field emitter of FIG. 1, a low voltage driving is nearly impossible since the anode electrode 13 is used as an acceleration electrode of the electron as well as a signal line of the display, even though the voltage necessary for electron emission is lowered by reducing the distance between the upper plate and the lower plate. In the field emission display, an electron having high energy of 200 eV or more is required to emit the light from the phosphor. The higher electron energy is, the better luminous efficiency is. Thus, a high-brightness field emission display can be obtained only if the high voltage is applied to the anode electrode.

In the conventional active-matrix field emission display having the diode field emitter shown in FIG. 2, the high voltage driving problem, non-uniformity of electron emission, cross talk, etc. can be solved by employing the control device 23 of the field emitter in each pixel and inputting the display signal through it. The high voltage applied to the anode electrode 24 for the field emission and electron acceleration, however, comes to induce a significant voltage to the control devices 23 of each pixel. Further, if the voltage is induced more than the breakdown voltage of the control devices 23, the control device could be broken.

Therefore, the conventional active-matrix field emission display has disadvantages that the voltage applied to the anode electrodes 24 may be confined depending on the breakdown characteristics of the control devices 23, whereby it is difficult to fabricate the field emission display having the high brightness.

SUMMARY OF THE INVENTION

Accordingly, the present invention has been made in view of the above problems, and the present invention is directed to a field emission display capable of significantly reducing the display row/column driving voltage by applying scan and data signals of the field emission display to the control device of each pixel.

In addition, the present invention is directed to a field emission display capable of improving the brightness in such a manner that the electric field necessary for a field emission is applied through the gate electrode of the gate plate to freely control the distance between the anode plate and the cathode plate, so that a high voltage can be applied to the anode.

A field emitter display of the present invention allows the gate plate and the cathode plate to be fabricated individually and then assembled, so that the fabricating process can be readily performed, and the productivity and yield can be improved by fundamentally removing the breakdown of the gate insulating film of the field emitter.

Further, according to the field emitter display of the present invention, the gate hole having the inclined inner wall serves to focus an electron beam, which is emitted from the field emitter, on a phosphor of the anode, and thus, the field emission display having a high resolution can be produced without an additional focusing grid.

The first aspect of the present invention is to provide a field emission display, comprising: a cathode plate having row/column signal lines of a belt shape for which row/column addressing is possible on a substrate, and pixels each defined by the row signal line and the column signal line, wherein each pixel has a film-shape field emitter and a control device for controlling the field emitter, having at least two terminals connected to the row/column signal lines and one terminal connected to the film-shape field emitter; an anode plate having a transparent electrode on the substrate and a phosphor on a portion of the transparent electrode, in each pixel; a gate plate having gate holes and a gate electrode around the top of the gate holes, said gate holes having an inclined inner wall; and spacers for supporting the gate plate between the cathode plate and the anode plate, wherein the field emitter of the cathode plate is constructed to be opposite to the phosphor of the anode plate through the gate holes, and is formed by vacuum packaging.

The second aspect of the present invention is to provide a field emission display, comprising: a cathode plate having row/column signal lines of a belt shape for which row/column addressing is possible on a substrate, and pixels each defined by the row signal line and the column signal line, wherein each pixel has a film-shape field emitter and a control device for controlling the field emitter, having at least two terminals connected to the row/column signal lines and one terminal connected to the film-shape field emitter; an anode plate having a transparent electrode on the substrate and a phosphor on a portion of the transparent electrode, in each pixel; a gate plate having gate holes and a gate electrode around the top of the gate holes, said gate holes each having an inclined inner wall; and spacers for supporting the gate plate between the cathode plate and the anode plate, wherein, the field emitter is composed of dots divided into a plurality of regions, the gate hole of the gate plate has the number corresponding to each of the dots, and at least one of the gate holes has an inclined inner wall.

Here, the spacers are formed between the anode plate and the gate plate.

Here, the anode plate, the cathode plate and the gate plate are formed of different transparent insulating substrates, respectively.

The third aspect of the present invention is to provide a field emission display, comprising: a cathode plate having row/column signal lines of a belt shape for which row/column addressing is possible on a substrate, and pixels each defined by the row signal line and the column signal line, wherein each pixel has a film-shape field emitter and a control device for controlling the field emitter, having at least two terminals connected to the row/column signal lines and one terminal connected to the film-shape field emitter; an anode plate having a transparent electrode on the substrate and a phosphor on a portion of the transparent electrode, in each pixel; and spacers for supporting the cathode plate and the anode plate, while keeping isolation therebetween by a predetermined distance, wherein an insulating layer including gate holes and a gate electrode around the top of the gate holes is further comprised on an upper portion of the cathode plate, in each pixel, said gate holes each having an inclined inner wall, and the field emitter of the cathode plate is constructed to opposite to the phosphor of the anode plate through the gate hole, and vacuum packaged.

The fourth aspect of the present invention is to provide a field emission display, comprising: a cathode plate having row/column signal lines of a belt shape for which row/column addressing is possible on a substrate, and pixels each defined by the row signal line and the column signal line, wherein each pixel has a film-shape field emitter and a control device for controlling the field emitter, having at least two terminals connected to the row/column signal lines and one terminal connected to the film-shape field emitter; an anode plate having a transparent electrode on the substrate and a phosphor on a portion of the transparent electrode, in each pixel; and spacers for supporting the cathode plate and the anode plate, while keeping isolation therebetween by a predetermined distance, wherein an insulating film including gate holes and a gate electrode around the top of the gate holes are further comprised on an upper portion of the cathode plate, in each pixel, said gate holes each having an inclined inner wall, the field emitter of the cathode plate is constructed to opposite to the phosphor of the anode plate through the gate hole, and vacuum packaged, and the field emitter is composed of dots divided into a plurality of regions, the gate hole of the gate plate has the number corresponding to each of the dots, and at least one of the gate holes has an inclined inner wall.

In a preferred embodiment of the present invention, the field emission display may further comprise an optical-shielding film at a given region between the phosphors of the anode to form a black matrix. Here, the image is represented by gray scale, by changing a pulse amplitude and/or pulse width (duration) of the data signal voltage applied to the field emitter through controlling of the control device.

In addition, the field emitter is composed of a thin film or a thick film comprising a diamond, a diamond carbon, or a carbon nanotube. The control device is a thin film transistor or a metal-oxide-semiconductor field effect transistor.

Further, a DC voltage is applied to the gate electrode to induce an electron emission from the film-shaped field emitter in the cathode plate; the emitted electrons are accelerated with high energy by applying the DC voltage to the transparent electrode of the anode plate; and scan and data signals are addressed to the control device of the field emitter in each pixel of the cathode plate, whereby the control device of the field emitter controls the electron emission of the field emitter to represent images.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF PREFERRED EMBODIMENTS

Hereinafter, preferred embodiments of the present invention will be described in detail with reference to the accompanying drawings. The embodiments of the present invention are intended to more completely explain the present invention to those skilled in the art.

EXAMPLE 1

A field emission display according to a first embodiment is significantly different comparing with that of the prior art field, in a cathode plate and a gate hole and a method of driving the same. Hereinafter, the field emission display will be described in detail with reference to FIGS. 3 to 6.

Figure 3:
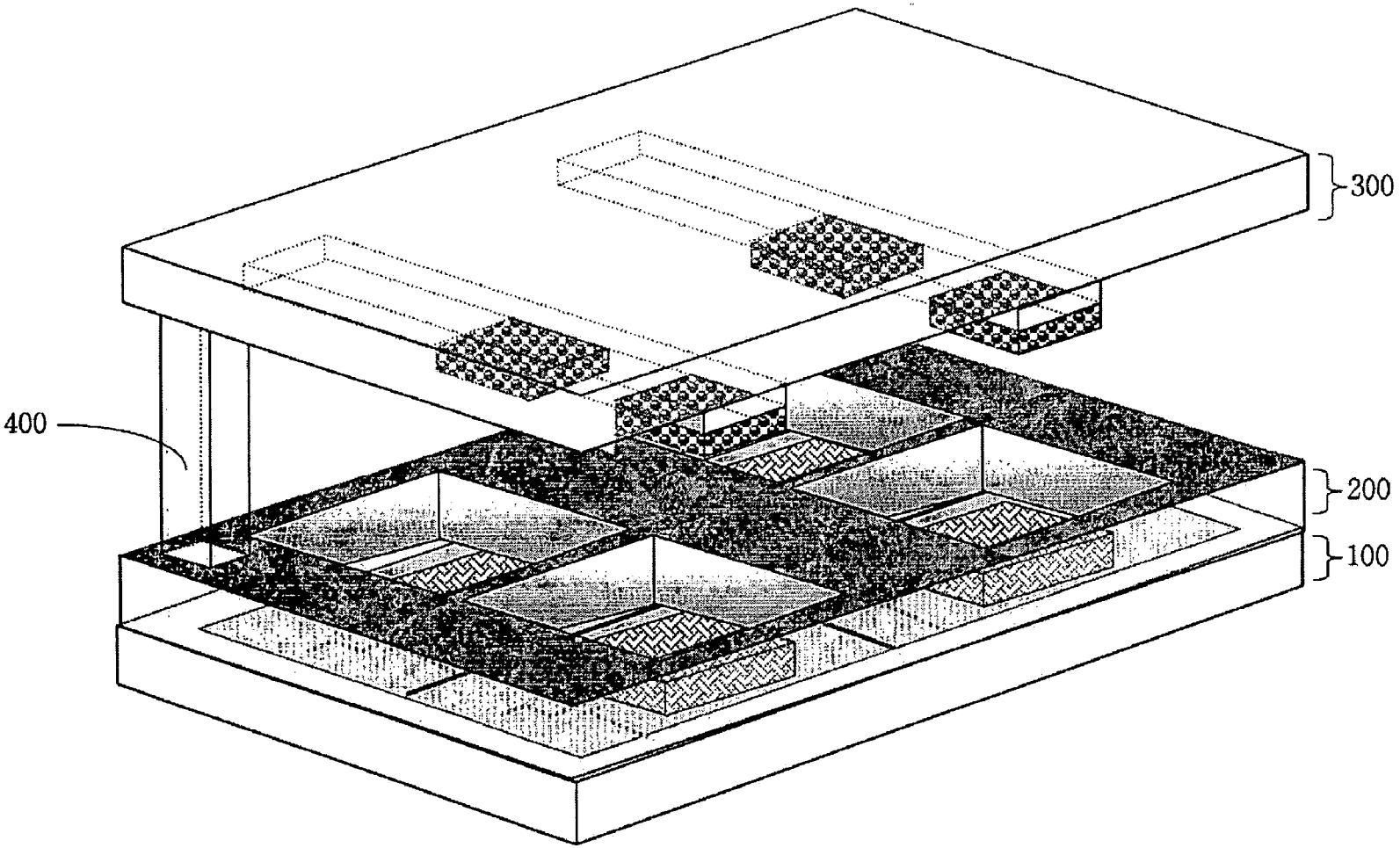
FIG. 3 is a perspective view for schematically showing a construction of an active-matrix field emission display having a gate plate, according to a first embodiment of the present invention.
Figure 4:
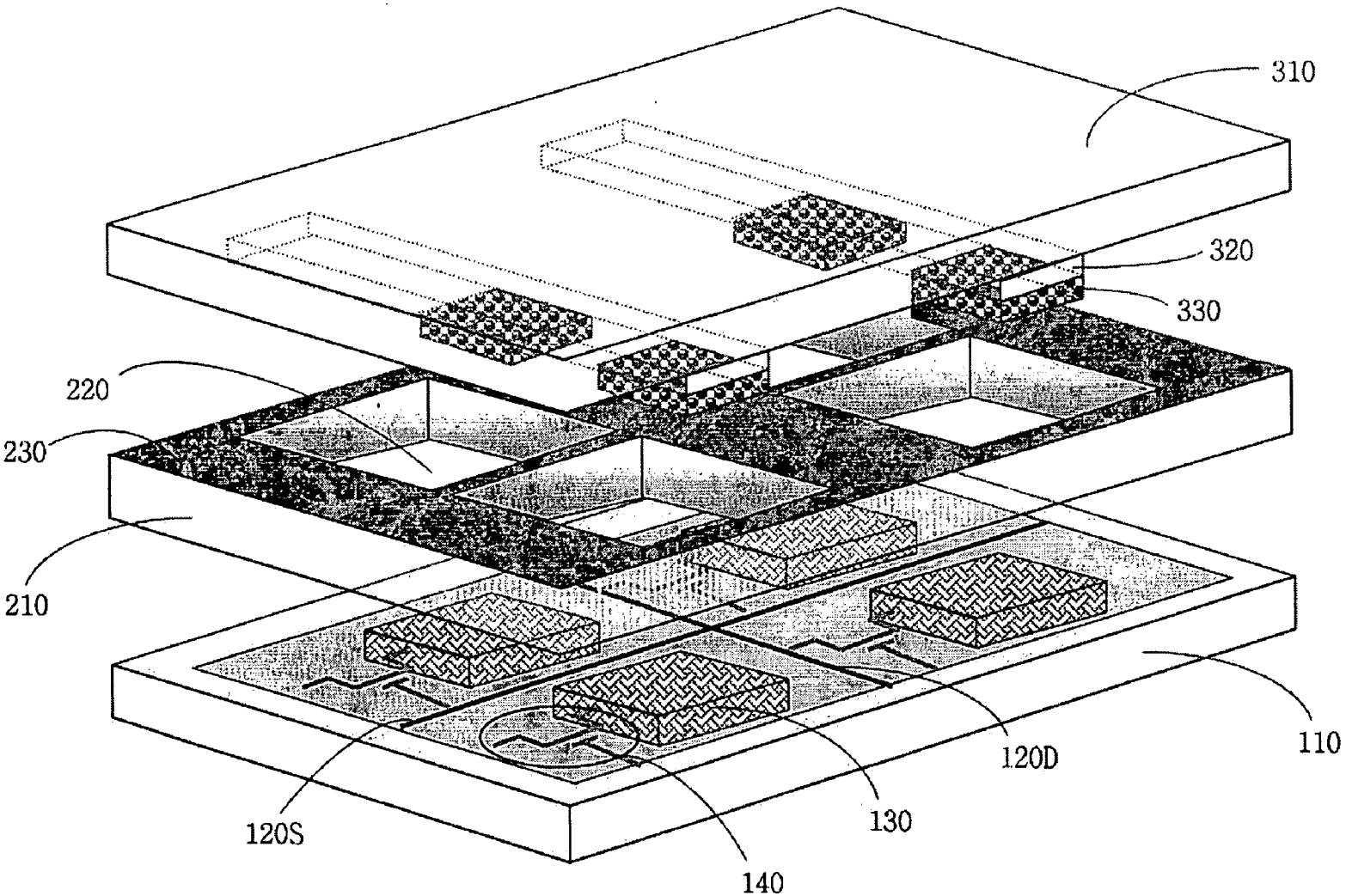
FIG. 4 is a perspective view for schematically showing a cathode plate, a gate plate and an anode plate in a field emission display, according to a first embodiment of the present invention.

FIG. 3 is a perspective view schematically illustrating a construction of an active-matrix field emission display having a gate plate according to the present invention and FIG. 4 is a perspective view schematically illustrating a cathode plate, a gate plate and an anode plate in a field emission display according to the present invention. The field emission display includes the cathode plate 100, the gate plate 200 and the anode plate 300.

The cathode plate 100 includes belt-shaped row signal lines 120S and column signal lines 120D on an insulating substrate 110, wherein the belt shaped row signal line and column signal line are made of a metal and enable to a row/column addressing, and the insulating substrate 110 may be a glass, a plastic, various kinds of ceramics, various transparent insulating substrate, etc. The unit pixels are defined by the row signal lines 120S and the column signal lines 120D. Each pixel includes a film-shaped (thin or thick film) field emitter 130 made of diamond, diamond like carbon, carbon nanotube, etc., and a control device 140 thereof. Preferably, the control device 140 has at least two terminals connected to the row signal line 120S and the column signal line 120D, and one terminal connected to the film-shaped field emitter 130. For example, the control device 140 may be an amorphous silicon thin film transistor, a polysilicon thin film transistor, or a metal-oxide-semiconductor field effect transistor.

The gate plate 200 includes gate holes 220 penetrating a substrate 210, and a gate electrode 230 made of a metal around the gate holes 220. The substrate 210 of the gate plate 200 can be formed by a transparent substrate such as a glass, a plastic, various ceramics, various transparent insulating substrates, or the like, and if necessary, a non-transparent substrate can be used as the substrate. The gate plate 200 may have a thickness in the range of 0.01 to 1.1 mm, for example, and a thickness of the gate electrode may be in the range of several hundreds of Å to several thousands of Å. The metal applicable to the gate electrode 230 may be chrome, aluminum, molybdenum, or the like, but not limited thereto. In addition, the gate holes 220 can be formed to be opened a little bit larger than each pixel so that the holes 220 can serve as an aperture of the unit pixel (for example, several tens of μm to several hundreds of μm) formed in the cathode plate 100.

Here, each of the gate holes 200 has an inclined inner wall. In other words, the size of the gate hole in the anode plate 300 is small as compared with that in the cathode plate 100. Therefore, the gate hole having the inclined inner wall serves to focus an electron beam, which is emitted from the field emitter, on a phosphor of the anode, whereby the field emission display having a high resolution can be produced.

Meanwhile, those skilled in the art will appreciate that a size and a shape of the gate hole 220, a thickness of the gate plate 200, a thickness of the gate electrode 230, etc. are not specially limited but can be variously modified.

The anode plate 300 includes a transparent electrode 320, and phosphors 330 of red (R), green (G) and blue (B) formed on a portion of the transparent electrode 320, on a transparent insulating substrate 310 made of a glass, a plastic, various ceramics, various transparent insulating substrate, etc.

Meanwhile, in the cathode plate 100, the gate plate 200 and the anode plate 300, the field emitter 130 of the cathode plate 100 are vacuum packaged parallel to the phosphor 330 of the anode plate 300 through the gate holes 220 of the gate plate 200, while facing each other, by using spacers 400 as a supporter. The spacers 400 can be manufactured by glass beads, ceramics, or, a polymer, and may have a thickness in the range of approximately 200 μm to 3 mm.

On the other hand, the gate electrode 230 may be also used as an optical-shielding film by selecting the type of a metal used as the gate electrode 230 or the thickness of the film.

Figure 5:
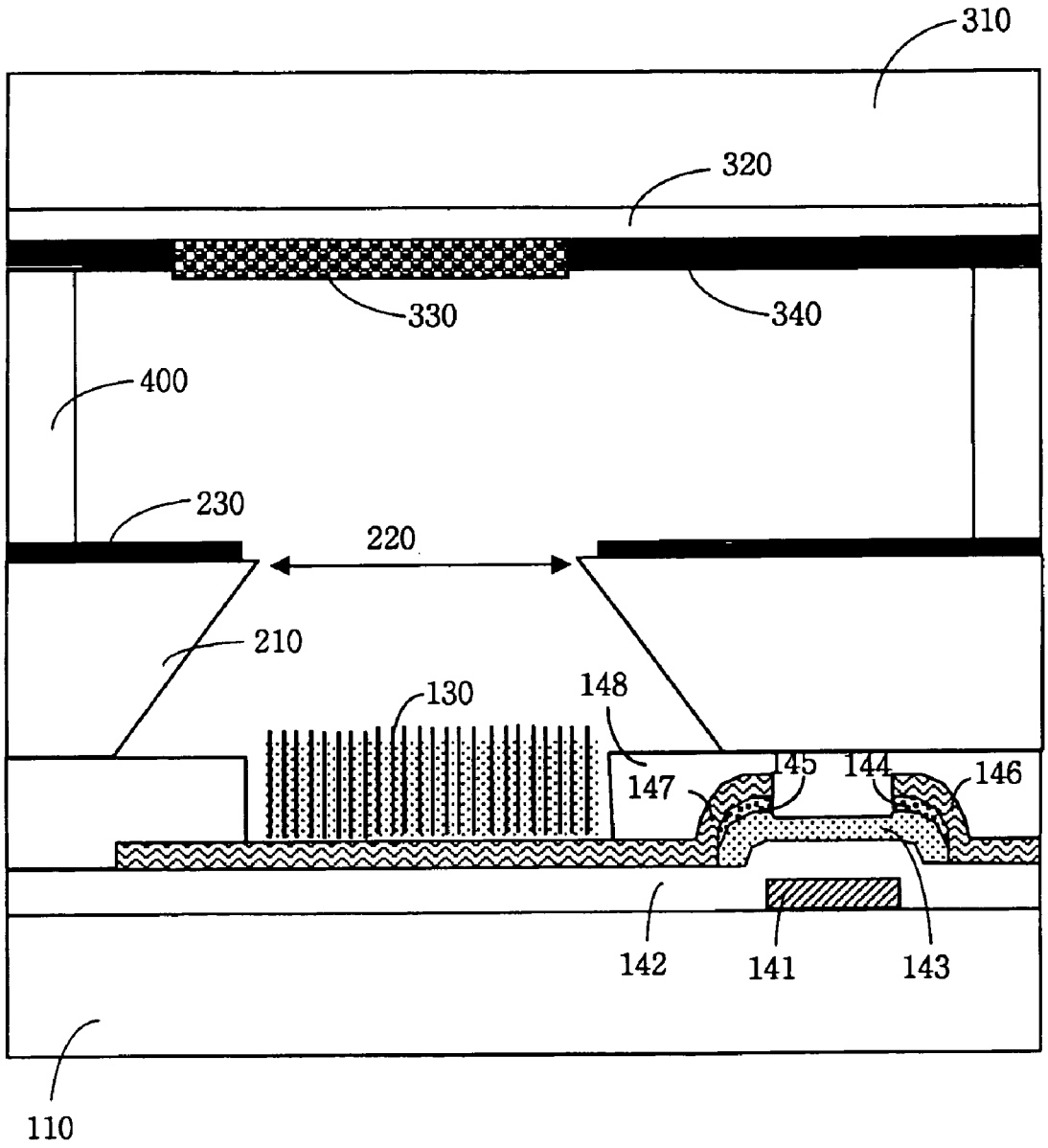
FIG. 5 shows a pixel structure of a field emission display according to a first embodiment of the present invention.

Next, a method of fabricating the field emission display according to an embodiment of the present invention will be described in detail with reference to FIG. 5. FIG. 5 is a cross-sectional view illustrating the unit pixel of the field emission display according to the present invention.

In the embodiment of FIG. 5, the gate plate is adhered to the cathode plate, while the anode plate is separated and vacuum packaged from the gate plate by a spacer supported between the anode plate and the gate plate. The cathode plate, the gate plate, and the anode plate can be fabricated separately and then combined together.

The unit pixel of the field emission display shown in FIG. 5 includes the cathode plate, the gate plate and the anode plate. The cathode plate has a substrate 110, a thin film transistor element, the field emitter, etc.

The thin film transistor element include a gate 141 made of a metal on the substrate 110, a gate insulating film 142 of the thin film transistor composed of an amorphous silicon nitride (a-SiNx) film or a silicon oxide film on the substrate 110 including the gate 141, an active layer 143 of the thin film transistor formed of an amorphous silicon (a-Si) on a portion of the gate 141 and the gate insulating film 142, a source 144 and a drain 145 of the thin film transistor formed of an n-type amorphous silicon at both ends of the active layer 143, a source electrode 146 of the thin film transistor formed of a metal on a portion of the source 144 and the gate insulating film 142, a drain electrode 147 of the thin film transistor formed of a metal on a portion of the drain 145 and the gate insulating film 142, and an interlayer insulating film (passivation insulating film) 148 composed of the amorphous silicon nitride film or the silicon oxide film on the active layer 143 and certain portions of the source electrode 146 and the drain electrode 147 of the thin film transistor.

The field emitter 130 may be formed of diamond, diamond like carbon, carbon nanotube, and the like on a portion of the drain electrode 147 of the thin film transistor.

The surface of the gate plate having no gate electrode 230 is adhered to the cathode plate, and the gate hole 220 is arranged in accordance with the field emitter 130 of the cathode plate. At this time, the anode plate is separated from the gate plate by using the spacers 400 as the supporter between them. Further, the anode plate is arranged and vacuum packaged so that the phosphor 330 of the anode plate is constructed to be opposite to the field emitter 130 of the cathode plate.

Each of the gate holes 200 has an inclined inner wall. The tilt angle is not confined specifically and various modifications thereof may be made, if the gate hole having the inclined inner wall serves to focus an electron, which is emitted from the field emitter, on a phosphor of the anode.

The spacers 400 serve to keep isolation between the cathode plate/the gate plate and the anode plate. It is not necessarily to be installed in every pixel.

The gate plate includes the gate holes 220 formed by penetrating the glass substrate 210, and the gate electrode 230 made of a metal around the gate holes 220.

The anode plate includes the transparent electrode 320 formed on a portion of the substrate 310, phosphors 330 of red, green, and blue formed on a portion of the transparent electrode 320, and a black matrix 340 formed between said phosphors 330.

Meanwhile, the manufacturing process can be readily performed since the gate plate and the cathode plate can be fabricated separately, and the gate insulating film in the field emitter fundamentally can be removed. Therefore, the gate plate, the cathode plate and the anode plate, which are fabricated individually, may be combined together. As a result, it is possible to significantly improve the manufacturing productivity and yield of the field emission display.

Hereinafter, a driving principle of the field emission display according to the first embodiment will be described with reference to FIGS. 3 to 5.

Figure 1:
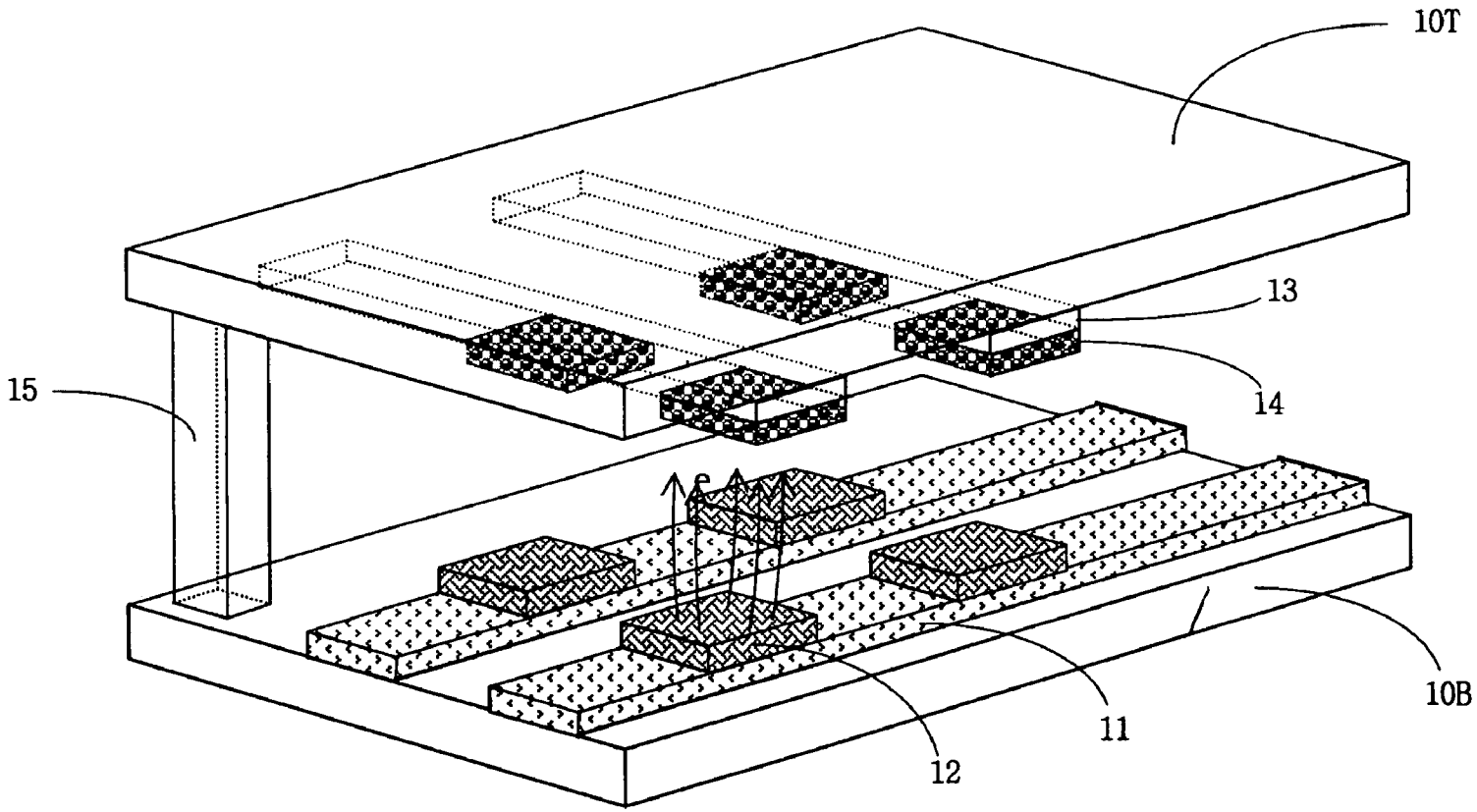
FIG. 1 (PRIOR ART)
FIG. 1 is a perspective view for schematically illustrating a construction of a conventional field emission display having a diode field emitter.
Figure 2:
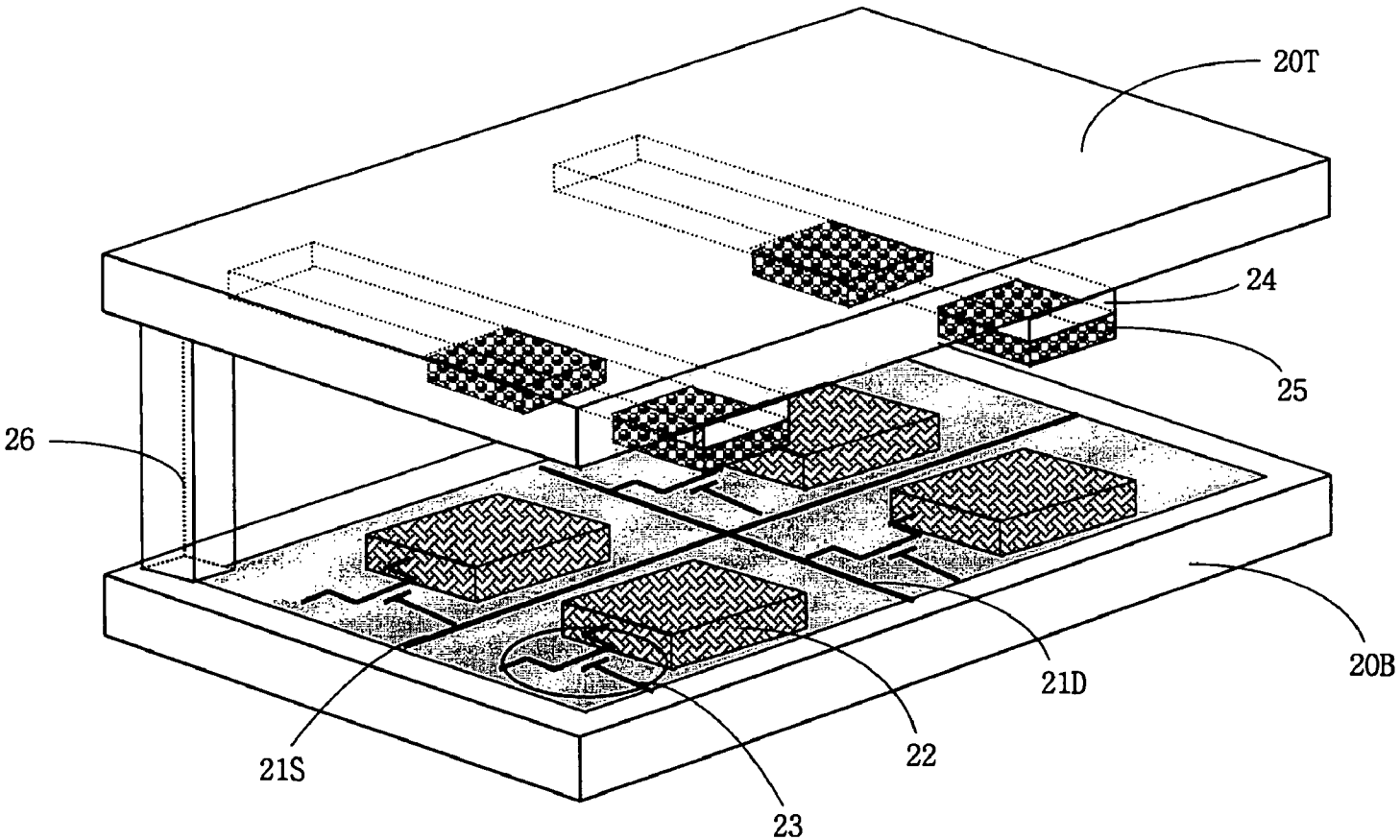
FIG. 2 (PRIOR ART)
FIG. 2 is a perspective view for schematically illustrating a construction of a conventional active-matrix field emission display having the diode field emitter.

The electron emission from the film-shaped field emitter 130 of the cathode plate is induced by applying a DC voltage in the range of 50 to 1500 V to the gate electrode 230 of the gate plate. At the same time, said emitted electrons are accelerated with high energy by applying a high voltage of approximately 2 kV or more to the transparent electrode 320 of the anode plate. Meanwhile, an operation of the control device of the field emitter in each pixel of the cathode plate could be controlled, by adjusting the voltages applied to the row signal line 120S and the column signal line 120D of the display. In other words, the control device (i.e. the control device 23 of FIG. 2) of the field emitter in each pixel represents an image by controlling an electron emission of the field emitter 130.

At this time, the voltage applied to the gate electrode 230 of the gate plate serves to prohibit an electron emission of the field emitter by the anode voltage, and also prevent a local arching by forming a totally uniform potential between the anode plate and the gate plate. The voltages applied to the row signal line 120S and the column signal line 120D of the display may be applied to the gate and the source of the thin film transistor, respectively. The voltage applied to the gate may be in the range of 10 V to 50 V when the thin film transistor having the active layer formed of an amorphous silicon is turned on, and may have a negative voltage when the transistor is turned off. Further, the voltage applied to the source may be approximately in the range of 0 to 50 V. The control of the applied voltage, as described above, can be made by an external driver circuit (not shown).

Subsequently, gray scale representation of the field emission display will be explained.

Gray scale representation of the common diode field emission device is implemented by using a pulse width modulation (PWM) mode. This is the mode that the duration of the voltage of the data signal applied to the field emitter is controlled to represent gray scale, and gray scale is represented by the difference in the amount of the electrons emitted for a given time. In other words, a corresponding pixel emits a light having high brightness, if there are plenty of electrons for a given time. However, the mode has a critical limitation where the width (time) of the pulse assigned to the unit pixel is gradually reduced in implementing a large-scale screen. Further, there is a problem that it is difficult to exactly control the amount of emitted electrons.

The driving method according to the present embodiment can overcome the above problems. Gray scale representation of the field emission display may employ the pulse width modulation (PWM) mode or the pulse amplitude (PAM)

mode, individually or a combination thereof. The PAM mode is that gray scale is represented based on the difference of the amplitude applied as the data signal. This mode employs that the amount of the electrons transported to the field emitter may be varied by the difference in the level of the voltage applied to the source in a state where the thin film transistor is turned on. Gray scale can be also represented by the difference of the voltage divided into two or more levels. This driving method can be applied to implement the large-scale screen and control the electrons emission constantly.

EXAMPLE 2

Hereinafter, a second embodiment or modified embodiments will be described in detail, with reference to FIG. 6.

Figure 6:
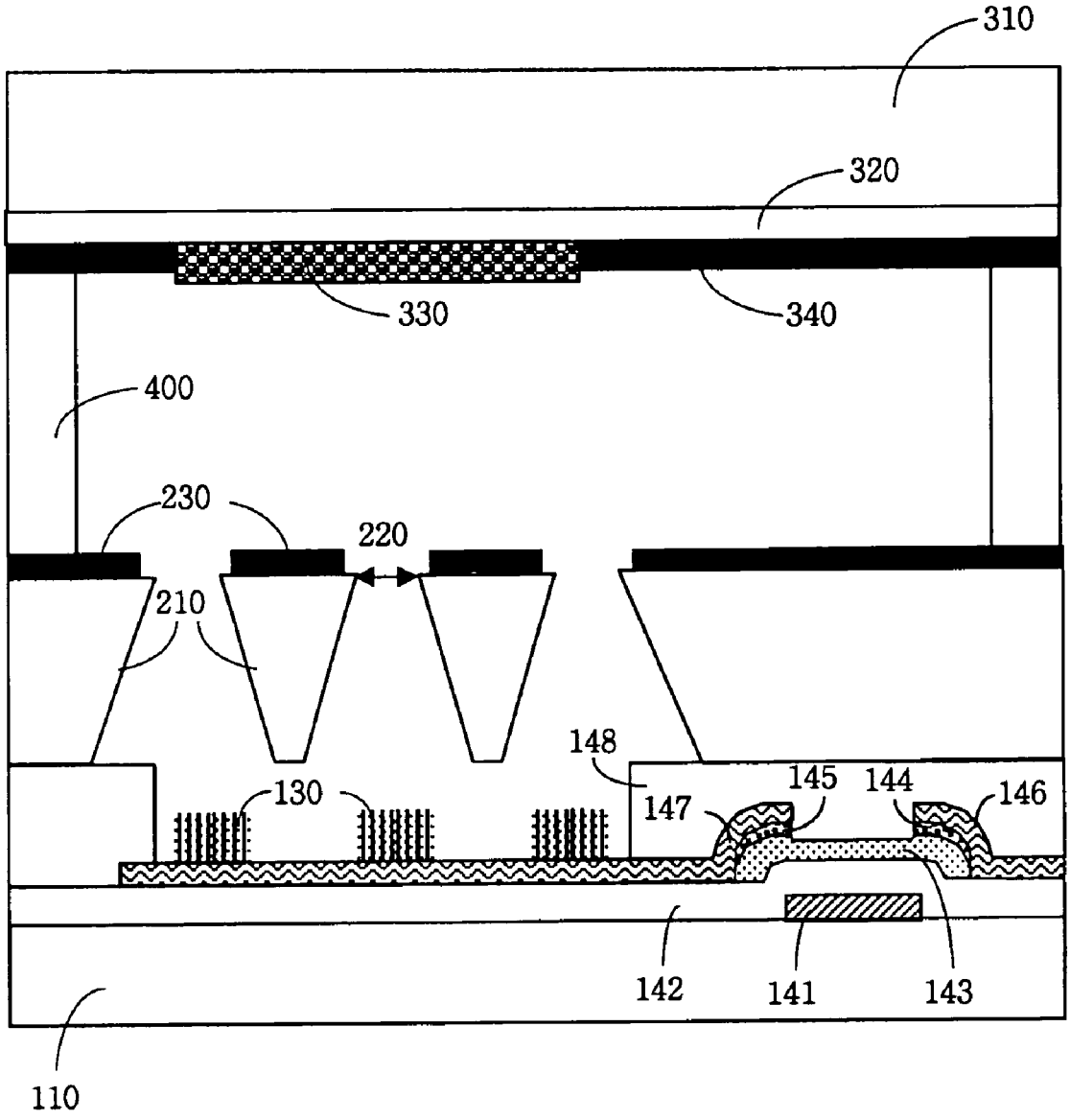
FIG. 6 shows a pixel structure of a field emission display according to a second embodiment of the present invention

FIG. 6 shows a constitution of a field emission display according to another embodiment of the present invention. In this case, the anode plate is the same as that of FIG. 5, except that the field emitter 130 of the cathode plate is composed of several dots and the gate hole of the gate plate has the number corresponding to each of the dots.

The constitution, as mentioned above, is very efficient to apply a high voltage to the anode plate. Thus, it is possible to prevent the high voltage from having a bad influence on the field emitter.

At least one of the gate holes 220 has an inclined inner wall, and the gate electrode 230 is placed around the top of the gate holes. On the other hand, FIG. 6 exhibits the gate holes 220 each having an inclined inner wall, but not limited thereto.

EXAMPLE 3

For convenience of explanation, Example 3 will be described on the basis of a difference with Example 1. In Example 1, the field emission display includes the cathode plate, the gate plate, and the anode plate. On the other hand, a field emission display of Example 3 includes a cathode plate and an anode plate.

According to Example 3, an insulating layer is formed on an upper portion of the cathode plate of Example 1 in which the filed emitter, the control device, and so on are formed without using an additional gate plate. Here, the insulating layer includes gate holes each having an inclined inner wall.

The insulating layer can be formed using various materials, which are not specifically confined. For example, the insulating layer is formed with a thickness in the range of 0.01 mm to 2 mm. The inclined inner wall in the hole gate of the insulating layer can be formed in such a manner that a plurality of insulating layers each having a different etching selection ratio are formed and etched by means of a wet etching method, or a green sheet that is made by stacking insulators each having a different etching ratio is attached to the cathode plate by means of a lamination method, and then annealed and etched.

Thus, according to Example 3 as described above, additional gate plate is not required, so that a process of attaching the gate plate to the cathode plate can be omitted and a production cost can be reduced.

EXAMPLE 4

For convenience of explanation, Example 4 will be described on the basis of a difference with Example 2. In Example 2, the field emission display includes the cathode plate, the gate plate, and the anode plate. On the other hand, a field emission display of Example 4 includes a cathode plate and an anode plate.

According to Example 4, an insulating layer is formed on an upper portion of the cathode plate of Example 2 in which the filed emitter, the control device, and so on are formed without using an additional gate plate. Here, the insulating layer includes gate holes each having an inclined inner wall.

Meanwhile, the field emitter of the cathode plate comprises a number of dots and the gate holes has the number corresponding to each of the dots in the field emitter of the cathode plate.

(Experiment)

Next, an experiment for a unit device of the field emission display having the practically fabricated gate plate according the first embodiment of the present invention will be explained.

Figure 7:
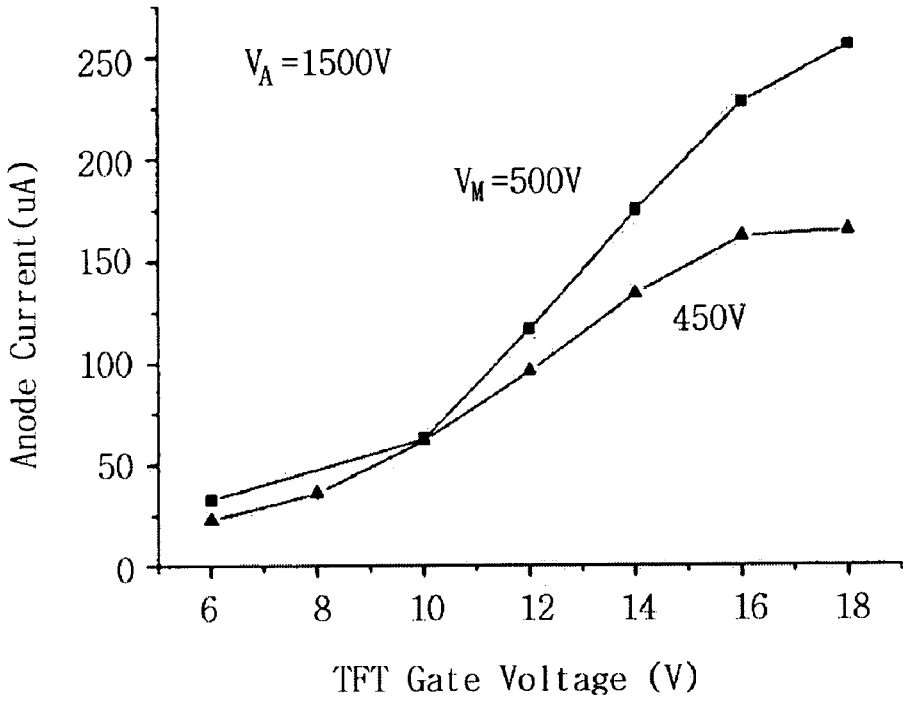
FIG. 7 is a graph showing an anode current depending on a gate voltage, in a field emission display according to a first embodiment of the present invention.

FIG. 7 is a graph showing an anode current depending on a gate voltage, in the field emission display including the gate plate with the gate holes, of which the inner walls are formed to be inclined.

In this experiment, the gate plate is fabricated to have a thickness of 0.4 mm, and the gate holes are formed to a circle. Here, diameters of a large portion and a small portion are 0.4 mm and 0.3 mm, respectively.

As a result, a tilt angle of an inclined inner wall is approximately $\tan^{-1} 10$. In addition, the control device is a thin film transistor (TFT).

Referring to FIG. 7, it can be noted that the anode emission current could be controlled by the voltage applied to the gate of the thin film transistor, in case where the voltage $V_A$ applied to the transparent electrode of the anode plate is 1500 V and the gate voltage $V_M$ changes to 450 V and 500 V, respectively. In addition, a leakage current of the gate in the gate plate was not nearly detected, and the anode voltage did not affect the anode emission current.

Figure 8:
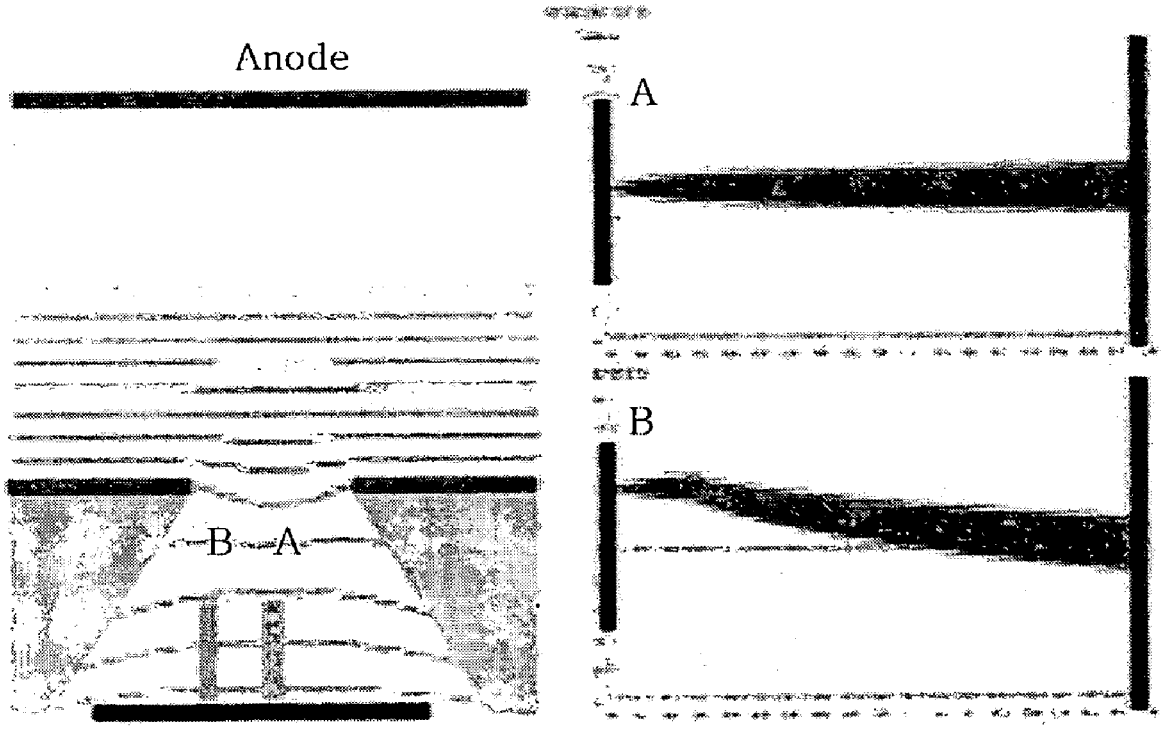
FIG. 8 is a graph showing simulation results of a potential contour and a trajectory of an electron beam, in a field emission display according to a first embodiment of the present invention.

FIG. 8 is a graph showing simulation results of a potential contour and a trajectory of an electron beam, in the case of the gate hole having an inclined inner wall. FIG. 8 shows the trajectory of the electron beam, which are calculated in a central portion A and an edge portion B of the field emitter, respectively.

According to the results of the simulation, a beam divergence was very small. Practically, it was measured to 0.1 mm or less at 0.5 V/μm. This is a small value, as compared to a spindt-type emitter. In conclusion, the gate hole having an inclined inner wall enables a fabrication of a filed emission display panel having a high resolution without an additional focusing grid, since it has a focusing effect itself.

As described above, the present invention has a merit that the display row/column driving voltage could be decreased remarkably, and thus, the low voltage driving circuit with low cost can be employed instead of a high voltage driving circuit, at the time of the row/column driving of the diode field emission display in accordance with the prior art.

Meanwhile, a distance between the anode plate and the cathode plate can be adjusted freely since an electric field required for an field emission can be applied via the gate electrode of the gate plate, so that a high voltage can be applied to the anode, and thus, brightness of the field emission display can be enhanced remarkably.

The voltage applied to the gate electrode 230 of the gate plate serves to prohibit an electron emission of the field emitter by the anode voltage, and prevent a local arching by forming a totally uniform potential between the anode plate and the gate plate, whereby the life time of the field emission display can be improved.

Further, the fabrication process is very easy since the gate plate and the cathode plate are fabricated individually, and it is possible to significantly improve the manufacturing productivity and yield of the field emission display since the breakdown phenomenon of the gate and the gate insulator can be eliminated fundamentally.

Meanwhile, the gate hole having the inclined inner wall serves to focus an electron, which is emitted from the field emitter, on a phosphor of the anode. As a result, the field emission display having a high resolution can be produced without an additional focusing grid.

Although the present invention have been described in detail with reference to preferred embodiments thereof, it is not limited to the above embodiments, and several modifications thereof may be made by those skilled in the art without departing from the technical spirit of the present invention.

The present application contains subject matter related to korean patent application no. 2003-89372, filed in the Korean Patent Office on Dec. 10, 2003, the entire contents of which being incorporated herein by reference.

What is claimed is:

1. A field emission display, comprising:

a cathode plate having row/column signal lines of a belt shape for which row/column addressing is possible on a substrate, and pixels each defined by the row signal line and the column signal line, wherein each pixel has a film-shape field emitter and a control device for controlling the field emitter, having at least two terminals connected to the row/column signal lines and one terminal connected to the film-shape field emitter;

an anode plate having a transparent electrode on a substrate and a phosphor on a portion of the transparent electrode, in each pixel;

a gate plate having gate holes of at least 10 um and a gate electrode around the top of the gate holes, said gate holes having an inclined inner wall; and spacers for supporting the gate plate between the cathode plate and the anode plate, wherein the field emitter of the cathode plate is constructed to be opposite to the phosphor of the anode plate through the gate holes, and is formed by vacuum packaging.

2. The field emission display as claimed in claim 1, wherein the anode plate, the cathode plate and the gate plate are formed of different transparent insulating substrates, respectively.

3. The field emission display as claimed in claim 1, wherein the spacers are formed between the anode plate and the gate plate.

4. The field emission display as claimed in claim 1, further comprising a black matrix at a given region between the phosphors of the anode.

5. The field emission display as claimed in claim 4, wherein the image is represented by gray scale, by changing a pulse amplitude and/or pulse width (duration) of the data signal voltage applied to the field emitter through controlling of the control device.

6. The field emission display as claimed in claim 1, wherein the field emitter is composed of a thin film or a thick film comprising a diamond, a diamond carbon, or a carbon nanotube.

7. The field emission display as claimed in claim 1, wherein the control device is a thin film transistor or a metal-oxide-semiconductor field effect transistor.

8. The field emission display as claimed in claim 1, wherein a DC voltage is applied to the gate electrode to induce an electron emission from the film-shaped field emitter in the cathode plate;

the emitted electrons are accelerated with high energy by applying a DC voltage to the transparent electrode of the anode plate; and scan and data signals are addressed to the control device of the field emitter in each pixel of the cathode plate, whereby the control device of the field emitter controls the electron emission of the field emitter to represent images.

9. A field emission display, comprising:

a cathode plate having row/column signal lines of a belt shape for which row/column addressing is possible on a substrate, and pixels each defined by the row signal line and the column signal line, wherein each pixel has a film-shape field emitter and a control device for controlling the field emitter, having at least two terminals connected to the row/column signal lines and one terminal connected to the film-shape field emitter;

an anode plate having a transparent electrode on a substrate and a phosphor on a portion of the transparent electrode, in each pixel;

a gate plate having gate holes of at least 10 um and a gate electrode around the top of the gate holes, said gate holes each having an inclined inner wall; and spacers for supporting the gate plate between the cathode plate and the anode plate, wherein, the field emitter is composed of dots divided into a plurality of regions, the number of gate holes of the gate plate corresponds to the number of the dots, and at least one of the gate holes has an inclined inner wall.

10. The field emission display as claimed in claim 9, wherein the anode plate, the cathode plate and the gate plate are formed of different transparent insulating substrates, respectively.

11. The field emission display as claimed in claim 9, wherein the spacers are formed between the anode plate and the gate plate.

12. The field emission display as claimed in claim 9, further comprising a black matrix at a given region between the phosphors of the anode.

13. The field emission display as claimed in claim 12, wherein the image is represented by gray scale, by changing a pulse amplitude and/or pulse width (duration) of the data signal voltage applied to the field emitter through controlling of the control device.

14. The field emission display as claimed in claim 9, wherein the field emitter is composed of a thin film or a thick film comprising a diamond, a diamond carbon, or a carbon nanotube.

15. The field emission display as claimed in claim 9, wherein the control device is a thin film transistor or a metal-oxide-semiconductor field effect transistor.

16. The field emission display as claimed in claim 9, wherein a DC voltage is applied to the gate electrode to induce an electron emission from the film-shaped field emitter in the cathode plate;

the emitted electrons are accelerated with high energy by applying a DC voltage to the transparent electrode of the anode plate; and scan and data signals are addressed to the control device of the field emitter in each pixel of the cathode plate, whereby the control device of the field emitter controls the electron emission of the field emitter to represent images.

17. A field emission display, comprising:

a cathode plate having row/column signal lines of a belt shape for which row/column addressing is possible on a substrate, and pixels each defined by the row signal line and the column signal line, wherein each pixel has a film-shape field emitter and a control device for controlling the field emitter, having at least two terminals connected to the row/column signal lines and one terminal connected to the film-shape field emitter;

an anode plate having a transparent electrode on a substrate and a phosphor on a portion of the transparent electrode, in each pixel; and spacers for supporting the cathode plate and the anode plate, while keeping isolation therebetween by a predetermined distance, wherein an insulating layer including gate holes of at least 10 um and a gate electrode around the top of the gate holes is further comprised on an upper portion of the cathode plate, in each pixel, said gate holes each having an inclined inner wall, and the field emitter of the cathode plate is constructed opposite to the phosphor of the anode plate through the gate hole, and vacuum packaged.

18. The field emission display as claimed in claim 17, wherein the anode plate and the cathode plate are formed of different transparent insulating substrates, respectively.

19. The field emission display as claimed in claim 17, further comprising a black matrix at a given region between the phosphors of the anode.

20. The field emission display as claimed in claim 19, wherein the image is represented by gray scale, by changing a pulse amplitude and/or pulse width (duration) of the data signal voltage applied to the field emitter through controlling of the control device.

21. The field emission display as claimed in claim 17, wherein the field emitter is composed of a thin film or a thick film comprising a diamond, a diamond carbon, or a carbon nanotube.

22. The field emission display as claimed in claim 17, wherein the control device is a thin film transistor or a metal-oxide-semiconductor field effect transistor.

23. The field emission display as claimed in claim 17, wherein a DC voltage is applied to the gate electrode to induce an electron emission from the film-shaped field emitter in the cathode plate;

the emitted electrons are accelerated with high energy by applying a DC voltage to the transparent electrode of the anode plate; and scan and data signals are addressed to the control device of the field emitter in each pixel of the cathode plate, whereby the control device of the field emitter controls the electron emission of the field emitter to represent images.

24. A field emission display, comprising:

a cathode plate having row/column signal lines of a belt shape for which row/column addressing is possible on a substrate, and pixels each defined by the row signal line and the column signal line, wherein each pixel has a film-shape field emitter and a control device for controlling the field emitter, having at least two terminals connected to the row/column signal lines and one terminal connected to the film-shape field emitter;

an anode plate having a transparent electrode on a substrate and a phosphor on a portion of the transparent electrode, in each pixel; and spacers for supporting the cathode plate and the anode plate, while keeping isolation therebetween by a predetermined distance, wherein an insulating layer including gate holes of at least 10 um and a gate electrode around the top of the gate holes is further comprised on an upper portion of the cathode plate, in each pixel, said gate holes each having an inclined inner wall, the field emitter of the cathode plate is constructed to opposite to the phosphor of the anode plate through the gate hole, and vacuum packaged, and the field emitter is composed of dots divided into a plurality of regions, the number of gate holes of the gate plate corresponds to the number of the dots, and at least one of the gate holes has an inclined inner wall.

25. The field emission display as claimed in claim 24, wherein the anode plate and the cathode plate are formed of different transparent insulating substrates, respectively.

26. The field emission display as claimed in claim 24, further comprising a black matrix at a given region between the phosphors of the anode.

27. The field emission display as claimed in claim 26, wherein the image is represented by gray scale, by changing a pulse amplitude and/or pulse width (duration) of the data signal voltage applied to the field emitter through controlling of the control device.

28. The field emission display as claimed in claim 24, wherein the field emitter is composed of a thin film or a thick film comprising a diamond, a diamond carbon, or a carbon nanotube.

29. The field emission display as claimed in claim 24, wherein the control device is a thin film transistor or a metal-oxide-semiconductor field effect transistor.

30. The field emission display as claimed in claim 24, wherein a DC voltage is applied to the gate electrode to induce an electron emission from the film-shaped field emitter in the cathode plate;

the emitted electrons are accelerated with high energy by applying a DC voltage to the transparent electrode of the anode plate; and scan and data signals are addressed to the control device of the field emitter in each pixel of the cathode plate, whereby the control device of the field emitter controls the electron emission of the field emitter to represent images.

* * * * *